US006848727B1

(12) United States Patent
Cetnar et al.

(10) Patent No.: US 6,848,727 B1
(45) Date of Patent: Feb. 1, 2005

(54) POWER DOOR LATCH ASSEMBLY

(75) Inventors: Roman Cetnar, Newmarket (CA); D'Arcy Miller, Lake Orion, MI (US)

(73) Assignee: Atoma International Corp, Newmarket (CA)

( * ) Notice: Subject to any disclaimer, the term of this patent is extended or adjusted under 35 U.S.C. 154(b) by 0 days.

(21) Appl. No.: 09/913,865

(22) PCT Filed: Feb. 18, 2000

(86) PCT No.: PCT/CA00/00164

§ 371 (c)(1),
(2), (4) Date: Jan. 25, 2002

(87) PCT Pub. No.: WO00/49252

PCT Pub. Date: Aug. 24, 2000

Related U.S. Application Data

(60) Provisional application No. 60/120,585, filed on Feb. 18, 1999.

(51) Int. Cl.[7] ..... E05C 3/06

(52) U.S. Cl. ..... 292/201; 292/216; 292/DIG. 23

(58) Field of Search ..... 292/201, DIG. 23, 292/216; 70/279, 264

(56) References Cited

U.S. PATENT DOCUMENTS

| | | | | |
|---|---|---|---|---|
| 4,518,180 A | | 5/1985 | Kleefeldt et al. | |
| 4,530,185 A | | 7/1985 | Moriya et al. | |
| 4,763,936 A | | 8/1988 | Rogakos et al. | |
| 5,137,311 A | * | 8/1992 | Brackmann | 292/216 |
| 5,603,537 A | * | 2/1997 | Amano et al. | 292/201 |
| 5,691,237 A | * | 11/1997 | Ohkura et al. | 148/DIG. 25 |
| 5,762,384 A | * | 6/1998 | Bartel | 292/201 |
| 5,802,894 A | * | 9/1998 | Jahrsetz et al. | 292/144 |
| 5,934,717 A | * | 8/1999 | Wirths et al. | 292/201 |
| 5,938,253 A | * | 8/1999 | Szablewski et al. | 292/201 |
| 5,992,194 A | * | 11/1999 | Baukholt et al. | 292/201 |
| 6,067,826 A | * | 5/2000 | Holloway et al. | 292/201 |
| 6,076,868 A | * | 6/2000 | Roger et al. | 292/199 |
| 6,148,651 A | * | 11/2000 | Roncin | 292/201 |
| 6,223,468 B1 | * | 5/2001 | Kobayashi | 292/201 |
| 6,279,361 B1 | * | 8/2001 | Baukholt et al. | 292/201 |
| 6,439,623 B1 | * | 8/2002 | Lohfeld et al. | 292/201 |

FOREIGN PATENT DOCUMENTS

| | | |
|---|---|---|
| DE | 197 11 563 A1 | 3/1997 |
| GB | 2 320 943 A | 12/1997 |

* cited by examiner

*Primary Examiner*—Robert J. Sandy
*Assistant Examiner*—Thomas Ho
(74) *Attorney, Agent, or Firm*—Clark Hill PLC

(57) ABSTRACT

A power door latch assembly consists of a ratchet (50) for engaging a door striker, a pawl (52), a rotary actuator (54) for rotating the ratchet (50) towards the closed position and for disengaging the pawl (52) and a drive actuator (96) for driving the rotary actuator (54). The drive actuator (96) includes a prime mover (98) an output member (104) in engagement with the rotary actuator (54), and releasable coupling (102) coupled between the prime mover (98) and the output member (104) for selectively transferring torque between the prime mover (98) and the rotary actuator (54). A drive controller (108) is coupled to the releasable coupling (102) and is configured for disengaging the prime mover (98) from the rotary actuator (54) when the ratchet (50) is disposed in either the open or closed positions.

9 Claims, 12 Drawing Sheets

POWER DOOR LATCH ASSEMBLY

This application is a 371 of PCT/CA00/00164 filed Feb. 18, 2000, which claims benefit to provisional application 60/120,585 filed Feb. 18, 1999.

FIELD OF THE INVENTION

This present invention relates to a latch assembly for and unlatching a member to and from a pillar in particular, the present invention relates to a powder door latch assembly for securing and unsecuring a vehicle door.

BACKGROUND OF THE INVENTION

A typical motor vehicle door is mounted in a door frame on the vehicle and is movable between open and closed positions. Usually the door is held in a closed position by the latching engagement between a spring-biased ratchet pivotally mounted inside the door latch and a U-shaped striker secured to the door frame. The ratchet is most often spring-biased toward the unlatched position to release the striker and is maintained in the latched position to hold the striker by a spring-biased pawl or other mechanical structure. The ratchet cannot pivot to release the striker until the pawl is moved.

The majority of these door latches are exclusively manually operated both to unlatch the door and to relatch the door. Typically, the manual release handles are provided on the inside and outside of the door to release the ratchet from the striker by moving the pawl so that the door can be opened. The door is closed and relatched by manually pivoting the door so that the ratchet impacts the striker with sufficient force to pivot the ratchet to the latched position against the spring force exerted by the ratchet spring.

It is often difficult, however, to completely close and latch manually latching vehicle doors on current model vehicles because the desire to reduce vehicle weight and to improve fuel economy has led engineers to design vehicles with relatively thin and lightweight doors. Often relatively hard door seals are used with these thin, lightweight doors to improve sealing around the door, particulary at high driving speeds. Because many vehicle doors are relatively lightweight and have relatively hard door seals, many vehicles doors often have insufficient internal energy when pushed closed to compress these hard door seals and fully pivot the ratchet to the latched position to latch the door.

Power assisted door latch assemblies have been developed to overcome the problems associated with latching doors with lightweight construction and hard door seals. Power assisted door latch assemblies allow low internal energy or soft closure of the lightweight doors without the need to slam the door even with the increased seal pressure that results from relatively hard door seals. Existing power associated door latch assemblies typically function to latch a vehicle door in one of two ways: 1) by forcing the ratchet to pivot in the closing direction after engagement with the striker or 2) by forcing the striker to move in a door-closing direction after the striker is fully engaged with the ratchet.

Use of either type of power associated door latch assembly decreases the noise associated with door closing and decreases the manual effort needed to completely close the door. Power assisted door latch assemblies are disclosed by Ishikawa (U.S. Pat. No. 4,986,579), Kobayahi (U.S. Pat. No. 5,273,324) and Dowling (U.S. Pat. No. 5,520,425). In Ishikawa, the door latch assembly includes an electric motor for rotating the spring-biased ratchet from the partially closed to the fully closed position, and an electric switch for activating and deactivating the electric motor. In Kobayashi, the door latch assembly includes a rotatable lever for rotating the ratchet plate into the fully closed position, an electric motor manipulating the lever, and a mechanical linkage extending between the lever and the ratchet plate for rotating the ratchet plate into the fully closed position. In Dowling, the door latch assembly includes a motor driven gear, and a flexible wire extending between the driven gear and the ratchet for rotating the ratchet from the partially closed to the fully closed position. However, Ishikawa requires a complex rotary actuator for operating the switch, whereas the mechanical link and the flexible wire used respectively in Kobayshia and Dowling inefficiently transfers mechanical torque between the electric motor and the ratchet plate.

Latch assemblies which provide both power assisted opening and power assisted closing are also in use. In these power assisted latch assemblies, the same source of power, typically an electric motor mounted within the vehicle door, is used both to open the latch and to close the latch. The mechanical locking mechanism and some door opening handles can be eliminated from the vehicle door when these latch assemblies are used.

Power assisted opening and closing latch assemblies are taught by Bernard (U.S. Pat. No. 4,664,430), Kleefeldt (U.S. Pat. No. 4,518,180) and Tamiya (U.S. Pat. No. 5,232,253). These types of latching assembly are often advantageously used with powered sliding vehicle doors in which the latch must be released before the power door opening mechanism can be actuated to open the door. Bernard uses a cylindrical ratchet plate and a disc rotatably mounted on a common shaft, a pawl pivotally mounted on the disc for engagement with the ratchet plate, and an electric screw drive for rotating the disc between an open latch position and a close latch position. Kleefeldt uses a motor-driven gear and a sliding toggle linkage mechanically coupled to the driven gear for opening and closing the ratchet Tamiya uses a rack-driven link for rotating the ratchet from the open position to the closed position, and a lever coupled to the link for releasing the pawl from the ratchet to allow the ratchet to be rotatably driven back to the open position. However, Bernard stresses the electric motor by using the motor as brake to retain the ratchet plate in the closed position, whereas the latching mechanisms taught by Kleefeldt and Tamiya may not be reliable in environments where the door is forcefully closed into the latch. Also, the sliding toggle linkage used by Kleefeldt limits the mechanical torque which is ultimately applied to the ratchet Accordingly, there remains a need for a simple, cost-effective power-assisted door latch assembly which efficiently transfers torque from the electric motor to the ratchet Further, there remains a need for a power-assisted door latch assembly which limits the stress applied to the electric motor by the ratchet.

SUMMARY OF THE INVENTION

According to the present invention, there is provided a power door latch assembly which addresses some of the deficiencies of the prior art The power door latch assembly, according to the present invention, comprises a ratchet for engaging a door striker, a pawl for engaging a detent surface provided on the ratchet for selectively resisting rotation of the ratchet towards the open position, a rotary actuator for rotating the ratchet towards the closed position and for disengaging the pawl from the detent surface, and a drive actuator for driving the rotary actuator. The drive actuator includes a prime mover, an output member in engagement with the rotary actuator, and a releasable coupling coupled between the prime mover and the output member for selectively transferring torque between the prime mover and the rotary actuator. The power door latch assembly also includes a drive controller for controlling operation of the drive actuator. The drive controller is coupled to the releasable coupling and is configured for disengaging the prime mover from the rotary actuator when the ratchet is disposed in either the open or closed positions.

According to the preferred embodiment of the invention, the door latch assembly provides for the power assisted opening and closing of a vehicle door with respect to a vehicle door frame between a closed position wherein the door is latched to a striker mounted on the door frame and an opened position in which the door is unlatched from the striker. The door latch assembly has a ratchet which cooperates with a mouth of a housing to releasably retain the striker. The door latch assembly also includes a pivotal pawl mounted in cooperating relation with the ratchet for biased movement into a holding position wherein the ratchet is held (1) in the secondary latched position against movement toward the unlatched position and (2) in the primary latched position against movement toward the secondary latched position. The pawl can be moved out of the holding position into a releasing position to allow the ratchet to move toward and into the unlatched position. The door latch assembly further includes a sector gear constructed and arranged to be moved from a null position in one direction through a closing stroke into a closing position and from the closing position through a return stroke to the null position and from the null position in an opposite direction through an opening stroke into an opening position and from the opening position through a return stroke into the null position. An actuator assembly includes a reversible electric motor and a clutch assembly for selectively driving the sector gear. The electric motor is operable (1) when energized to rotate in one direction to drive the sector gear through the closing stroke thereof and (2) when energized to rotate in an opposite direction to drive the sector gear through the opening stroke thereof. The sector gear has a closing arm constructed and arranged to cause a movement of the ratchet from the secondary latched position thereof to the primary latched position thereof. The sector gear has an opening arm constructed and arranged to cause a movement of the pawl from the holding position thereof to the releasing position thereof to release the ratchet.

Preferably, the sector gear has a spring for urging the sector gear to move through the return strokes thereof from opening and closing positions thereof when the actuator is de-energized.

Preferably the door latch assembly includes an energizing closing switch constructed and arranged to be actuated in response to the movement of the ratchet into the secondary latched position thereof to energize the electric motor to thereby move the sector gear through a closing stroke so that the closing arm causes the ratchet to move from the secondary latched position thereof into the primary latched position thereof and a closing de-energizing switch constructed and arranged to be actuated in response to the movement of the ratchet into the primary latched position thereof to de-energize the electric motor and allow the spring system to effect a return stroke of the sector gear. The power operated driving assembly further includes a manually operable opening energizing switch constructed and arranged to energize the electric motor in response to a manual actuation thereof to move the sector gear through an opening stroke so that the opening structure thereof causes the ratchet to move out of the primary position thereof to allow the door to be moved into an open position and a timer closing de-energizing switch constructed and arranged to be actuated in response to the movement of the pawl into the releasing position thereof to de-energize the electric motor after a predetermined time and allow the spring system to effect a return stroke of the sector gear.

Preferably, the ratchet and the sector gear am pivotally mounted about a common axis and the pawl is pivotally mounted about an axis that is parallel to the common axis.

Preferably, the door latch assembly includes a housing having a striker receiving opening therein constructed and arranged to be mounted in the vehicle door so that the opening receives the striker during a door closing movement. The ratchet is pivotally mounted on the housing with the striker engaging structure facing outwardly within the opening when the ratchet is in the unlatched position. The latching structure extends within the opening when the ratchet is in the latched positions. The housing carries the pawl, the sector gear and the power operated driving assembly.

BRIEF DESCRIPTION OF THE DRAWINGS

The present invention will now be described, by way of example only, with reference to the accompanying drawings, in which.

DETAILED DESCRIPTION OF THE PREFERRED EMBODIMENT

Figure 1:
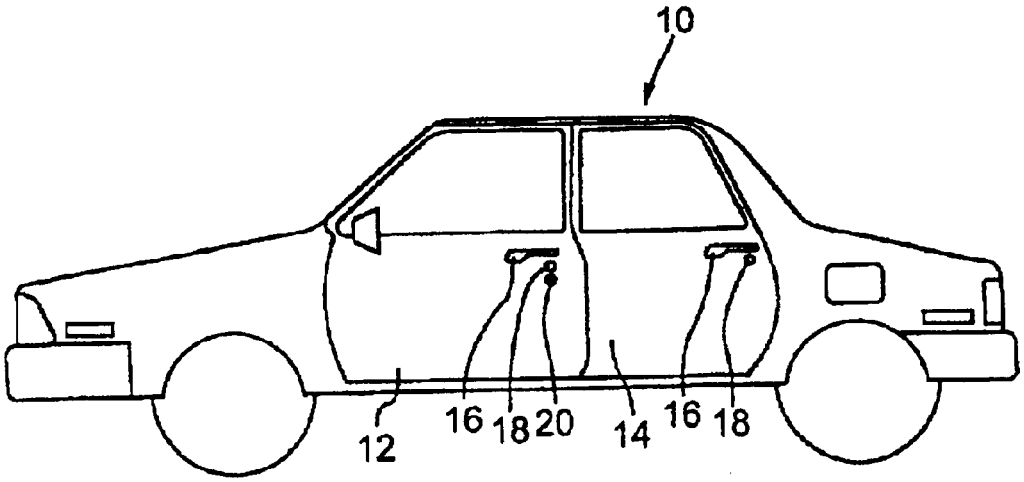
FIG. 1 is an elevational view of the left side of a conventional four-door vehicle.

FIG. 1 shows a left side elevational view of the exterior of a conventional motor vehicle that has a front door 12 and a back door 14. Each door 12, 14 has an exterior handle 16 and a door latch opening button 18. The front door 12 has a conventional key-operated lock cylinder to lock and unlock the door 12.

A power operated door latch assembly 22 constructed according to the principles of the present invention is mounted on each door of the vehicle 10 for the power assisted latching and unlatching of each door.

Figure 2:
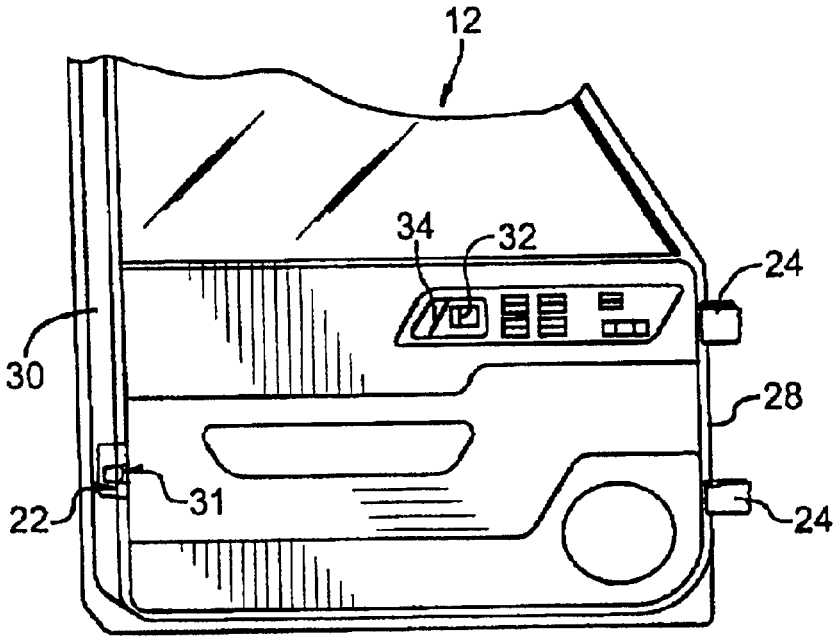
FIG. 2 is an isolated fragmentary perspective view of the interior of a front door of the vehicle shown in FIG. 1.

FIG. 2 shows an isolated view of the inside of the front door 12. Two hinges 24 are secured to a first inner edge 28 of the door 12 to pivotally mount the door 12 to a door frame on the vehicle 10 in a conventional manner so the door can be moved between open and closed positions. A power operated door latch assembly 22 is mounted on a second outer edge 30 of the door. The door 12 has an interior door release switch 32 to unlatch the door latch assembly 22 with power assistance and an interior manual door release handle 34 to manually unlatch the door 12 using a manual override.

A conventional U-shaped striker is rigidly secured to the door frame of the vehicle 10 in a conventional manner. When the door 12 is moved to the closed position, the door 12 pivots into the door frame and the door latch assembly 22 impacts the striker to latch the door 12.

Figure 3:
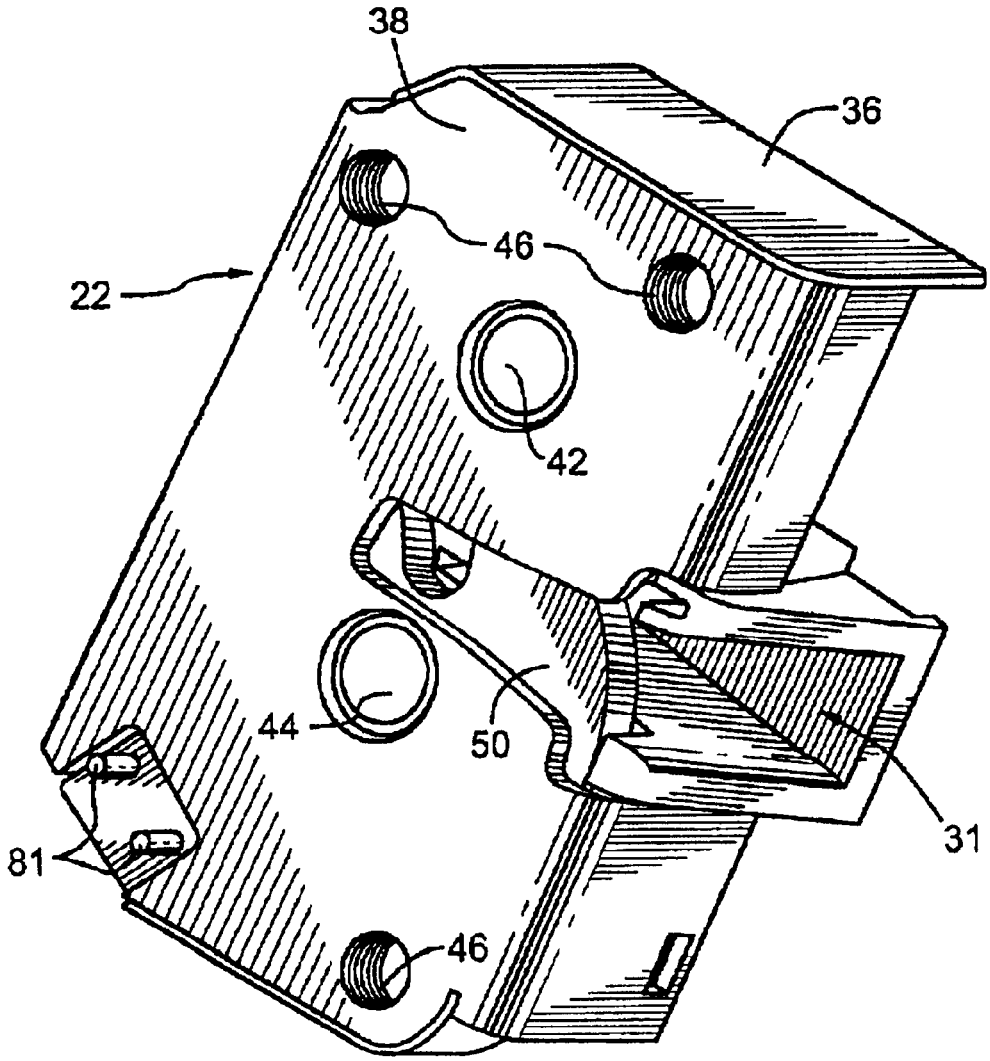
FIG. 3 is a perspective view at a first side of a power assisted door latch assembly embodying the principles of the present invention.
Figure 4:
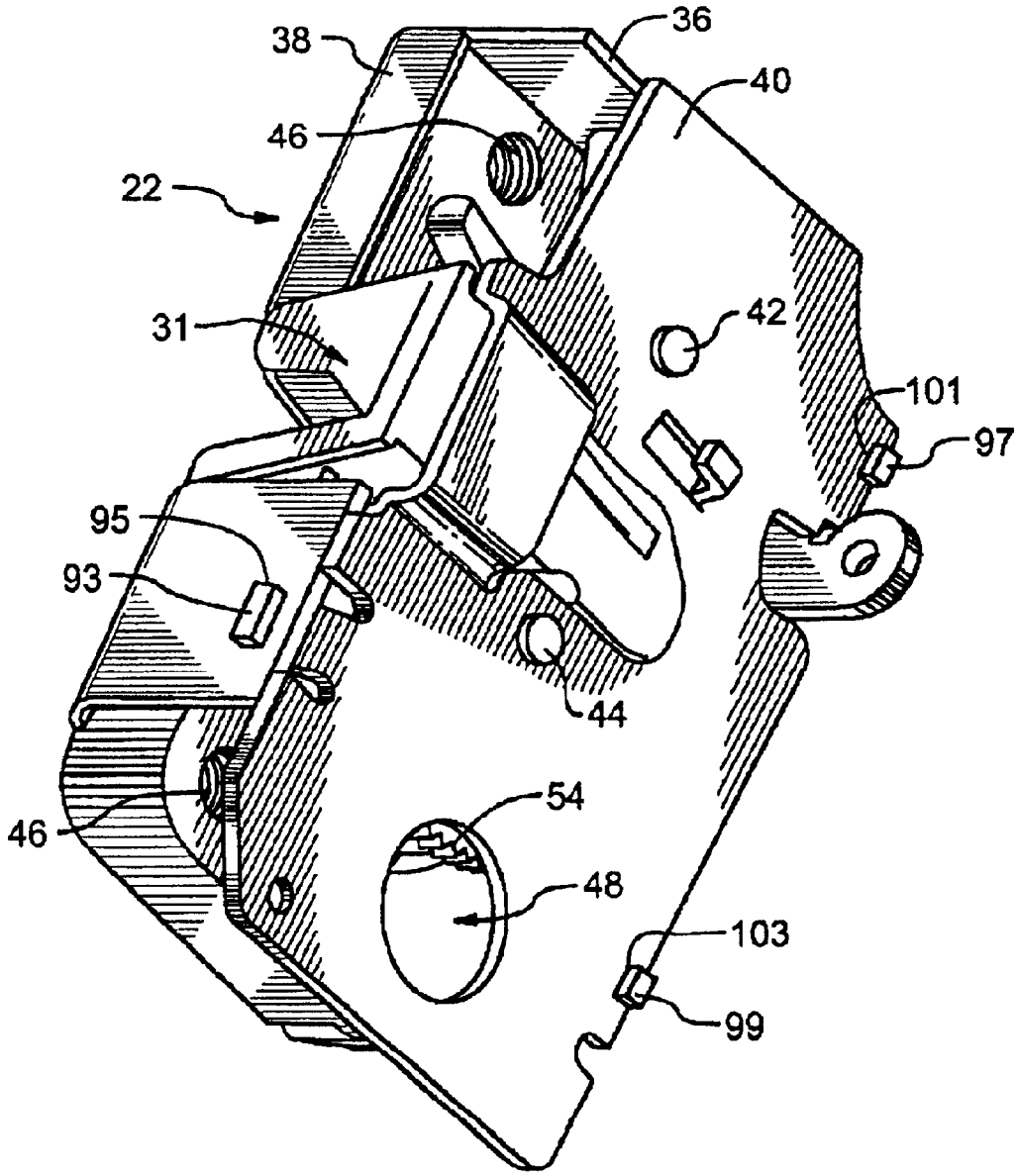
FIG. 4 is a perspective view of a second side of the power assisted door latch assembly shown in FIG. 3.

Referring to FIGS. 3 and 4, the door latch assembly 22 includes a housing 36 and a first cover 38 and second cover 40 secured to the first cover 38. The covers 38, 40 are secured to the housing 36 by conventional staking pins 42, 44 or other suitable fasteners. The housing 36 engages threaded holes 46 to mount the door latch assembly 22 to a door 12 with conventional bolts or other suitable means. Housing 36 has a mouth structure 31. Tab 93 on the second cover 40 extends through a slot 95 in the first cover 38 and two tabs 97, 99 on the first cover 38 clip over the edge of the second cover 40 at 101, 103 to close the door latch assembly 22.

Figure 5:
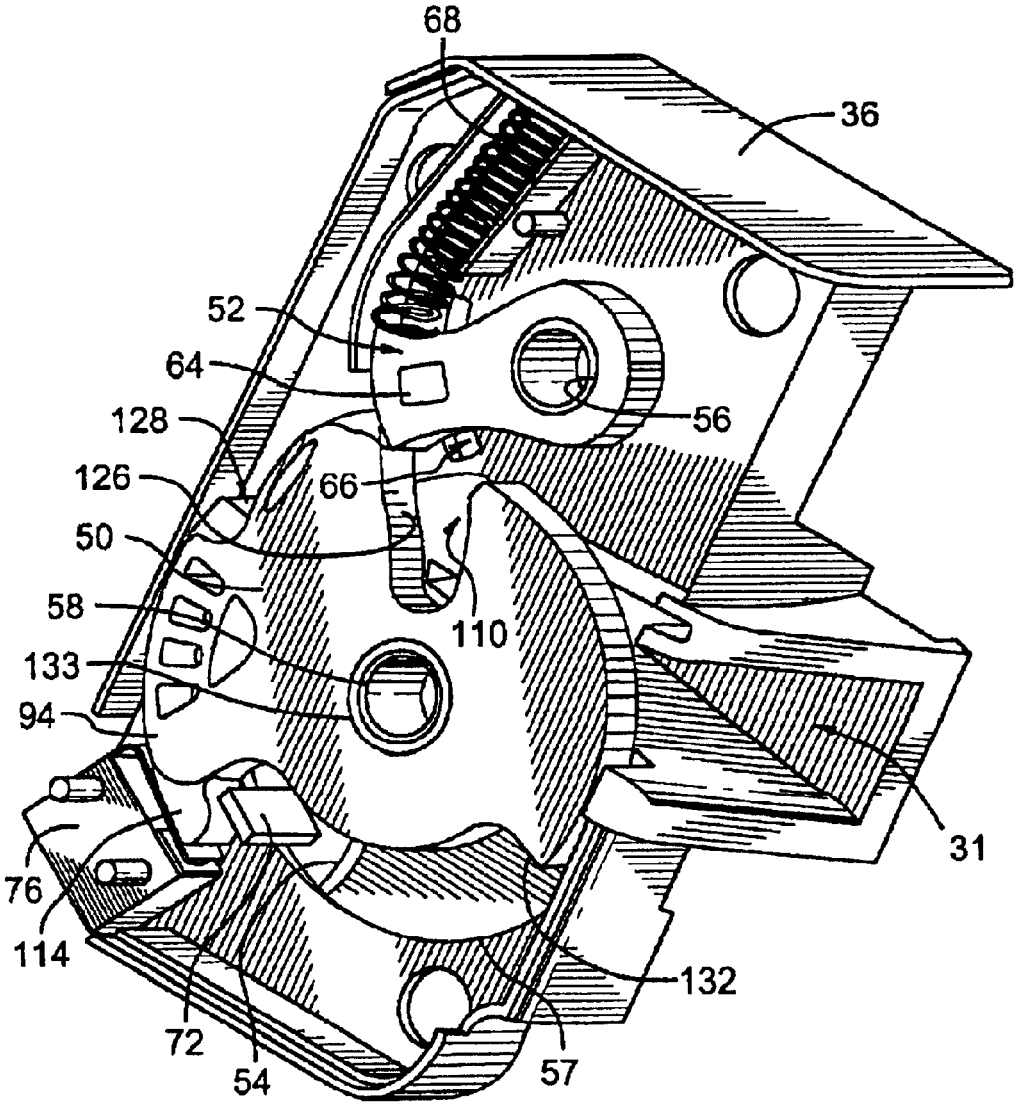
FIG. 5 is a perspective view similar to FIG. 3 of the door latch assembly with a first cover and a second cover removed.

Referring to FIG. 5, the housing 36 has a conventional bushing 58 for rotatably mounting the ratchet 50 on pin 44 (FIG. 6) between an unlatched or open position and a primary latched or closed position. Ratchet 50 has a conventional detent fork structure having a notch 110 presenting a primary detent surface 126. The ratchet 50 has a secondary detent 128 spaced circumferentially from the primary detent 126. The ratchet 50 has a contoured edge diametrically opposite the notch 110 presenting a cinch drive area 132 and a release clearance area 114. Ratchet 50 cooperates with the mouth 31 to engage and cinch the striker 106 (FIG. 8) to hold the door closed.

Figure 6:
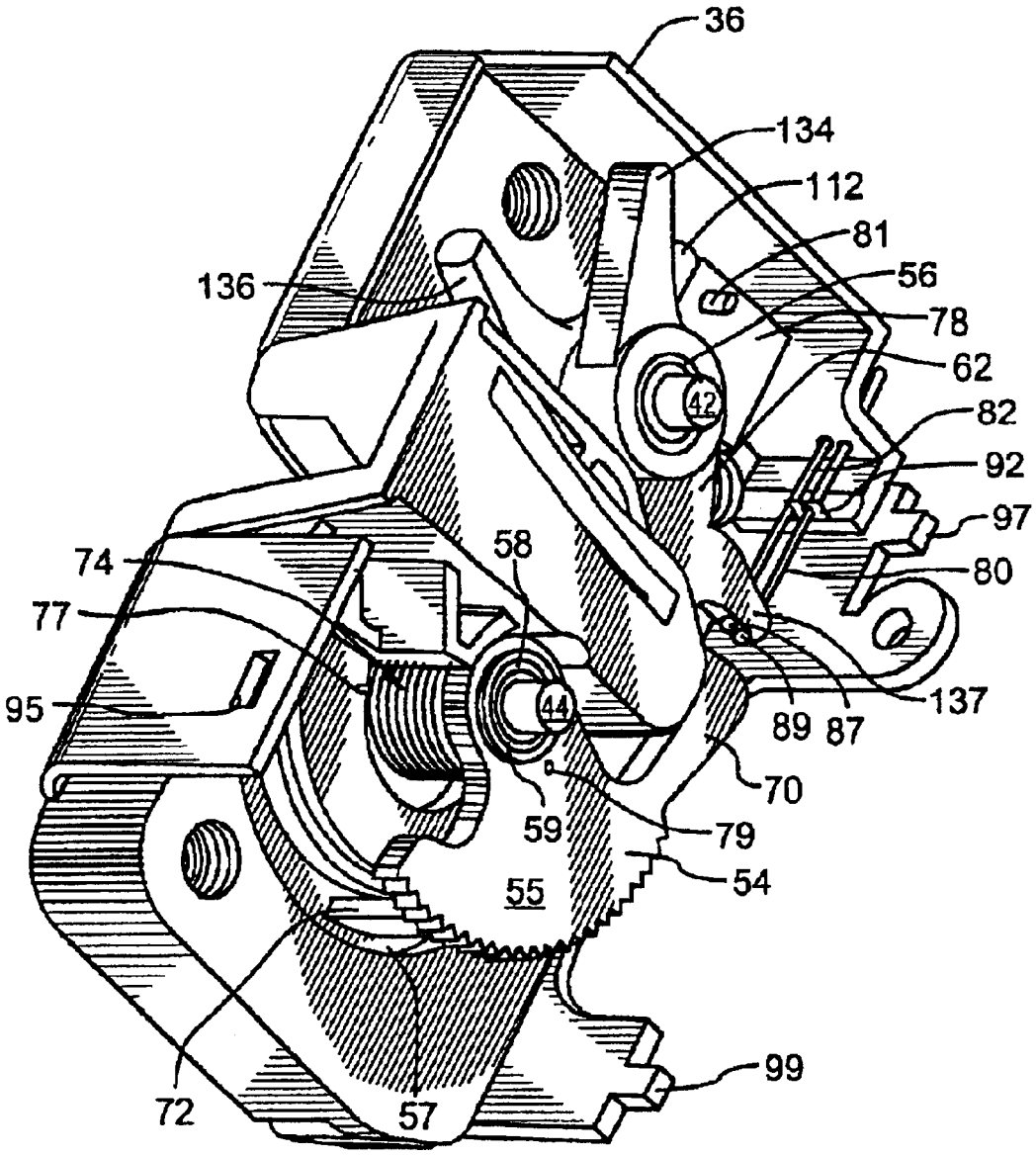
FIG. 6 is a perspective view similar to FIG. 4 of the door latch assembly with the second over removed.

Housing 36 has a conventional bushing 56 for rotatably mounting the pawl 52 on pin 42 (FIG. 6). Arcuate slot 66 receives connecting arm 64 and allows travel of the pawl 52 between a latching position and a full release overtravel position. Pawl spring 68 extends between the housing 36 and the pawl 52 to bias the pawl 52 against the ratchet 50 to follow the contours of the circumference thereof. Housing 36 has a channel for retaining the pawl spring 68.

Referring to FIG. 6, a sector gear 54 is commonly mounted on pin 44 on a side of the housing opposite the ratchet 50. Sector gear 54 is mounted in such a manner that the sector gear 54 is able to rotate relative to or independently of the ratchet 50. The sector gear 54 has an opening or releasing arm 70 which extends tangentially from a toothed portion 55. The sector gear 54 also has a closing or cinching arm 72 which extends axially from the toothed portion 55. Coil springs 74 are mounted around sector bearing cylinder 59 with a first end 77 engaging the housing 36 and a second end 79 engaging the sector gear 54. Springs 74 bias sector gear 54 into a null position.

Housing 36 has an arcuate slot 57 through which closing arm 72 extends for engagement with cinch drive area 132 of ratchet 50. As sector gear 54 rotates, it will rotate independently of the ratchet 50 until it engages the cinch drive area 132. In the release direction, the travel of sector gear 54 is not obstructed by the ratchet 50 due to the release clearance area 114. Thus, sector gear 54 has a "lost motion" relative to the ratchet 50.

A release lever 62 is commonly mounted on housing bushing 56 on opposite sides of the housing 36 from the pawl. Housing 36 has an arcuate slot 66 through which connecting arm 64 (FIG. 5) extends coupling the pawl 52 and the release lever 62 together for pivotal movement as a single unit. Release lever 62 has a hub from which arms 112, 117 (FIG. 8), 134, 136 and 137 radially extend.

Pin 42 provides pivotal support for the pawl 52 and release lever 62 and the pin 44 provides pivotal support for the ratchet 50 and the sector gear 54. Therefore, the pin 44 defines a rit pivot axis for both the ratchet 50 and the sector gear 54 and the pin 42 defines a second pivot axis for the pawl 52 and release lever 62. These two axes are essentially parallel.

A first electrical switch 76 (FIG. 5) is mounted on the housing 36 and positioned to engage the outer cam surface of the release clearance area 114 as the ratchet 50 rotates. The pivotal movement of ite ratchet 50 will switch or toggle the switch 76 between an "on" state and an "off" slate. A second electrical switch 78 is mounted on housing 36 and positioned to engage arm 112 of the release lever 62. The pivotal movement of the release lever 62 will switch or toggle the switch 78 between an "on" state and an "off" state. Each switch 76, 78 has two conventional electrical connectors 81 (FIG. 3) to connect the switches to a controller 108 (FIG.

Wire 80 and bowden wire 82 engage arm 137 of release lever 62. The outer sheath of the bowden wire 82 is mounted to the housing to effect actuation of the bowden wires. Each end of the wires 80, 82 has a cap 87, 89 which allows the wires 80, 82 to slide relative to the release lever 62. Thus, wires 80 and 82 do not interfere with the movement of the pawl 52 between the holding and releasing positions during power assisted door opening and closing.

Figure 7:
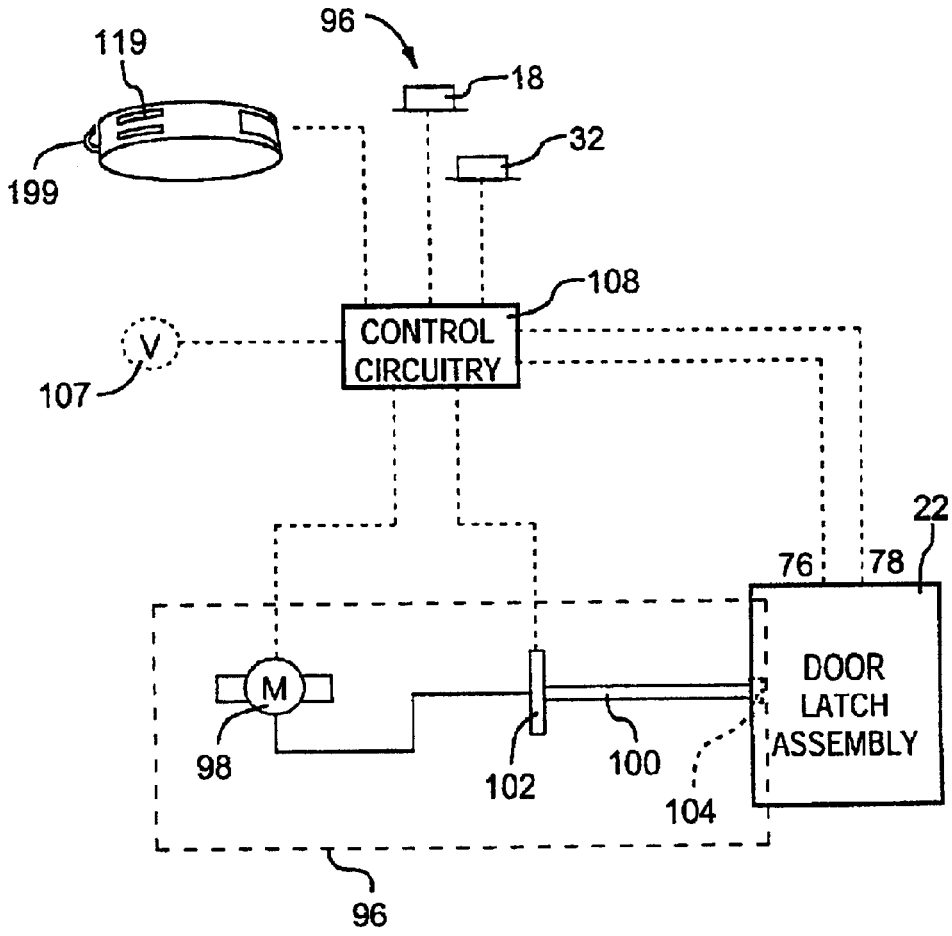
FIG. 7 is a schematic view showing a power operated driving assembly, a power source, a voltage source and controller for the door latch assembly.

Referring to FIG. 7, actuator 96 is mounted on the face of the plate 40. Actuator 96 includes a motor 98 and a clutch assembly to selectively drive the sector gear 54. The second cover 40 has an opening 48 (FIG. 4) through which a drive shaft 100 extends A drive gear 104 is mounted on the drive shaft 100 and engages the sector gear 54 to provide torque amplification for movement of the sector gear 54 and the pawl 52. The motor 98 and clutch assembly 102 are energized by the vehicle's electrical system which is schematically represented as a voltage source 107. The motor 98, clutch assembly 102 and the drive shaft 100 are mounted within the door 12. A portion of the drive shaft 100 is carried in the door latch assembly 22 to support the drive gear 104 in the housing 36 and engage the sector gear 54 with the drive gear 104.

A controller 108 controls the motor 98 and clutch assembly 102 by energizing and de-energizing the same in response to switching signals from the switches 18 and 32 on the door 12, a remote control 199 and the switch members 76, 78 in the door latch assembly 22.

The covers 38, 40 are preferably made of steel or other appropriate material. The ratchet 50 and first pawl member 52 are preferably made of steel or other suitable metal, having a plastic cover 94. The release lever 62 and the sector gear 54 can be made of any suitable plastic or metal. The conventional bushings 56, 58 are integral with the housing 36 and are preferably a composite material such as nylon.

The Primary Latched Position

Figure 8:
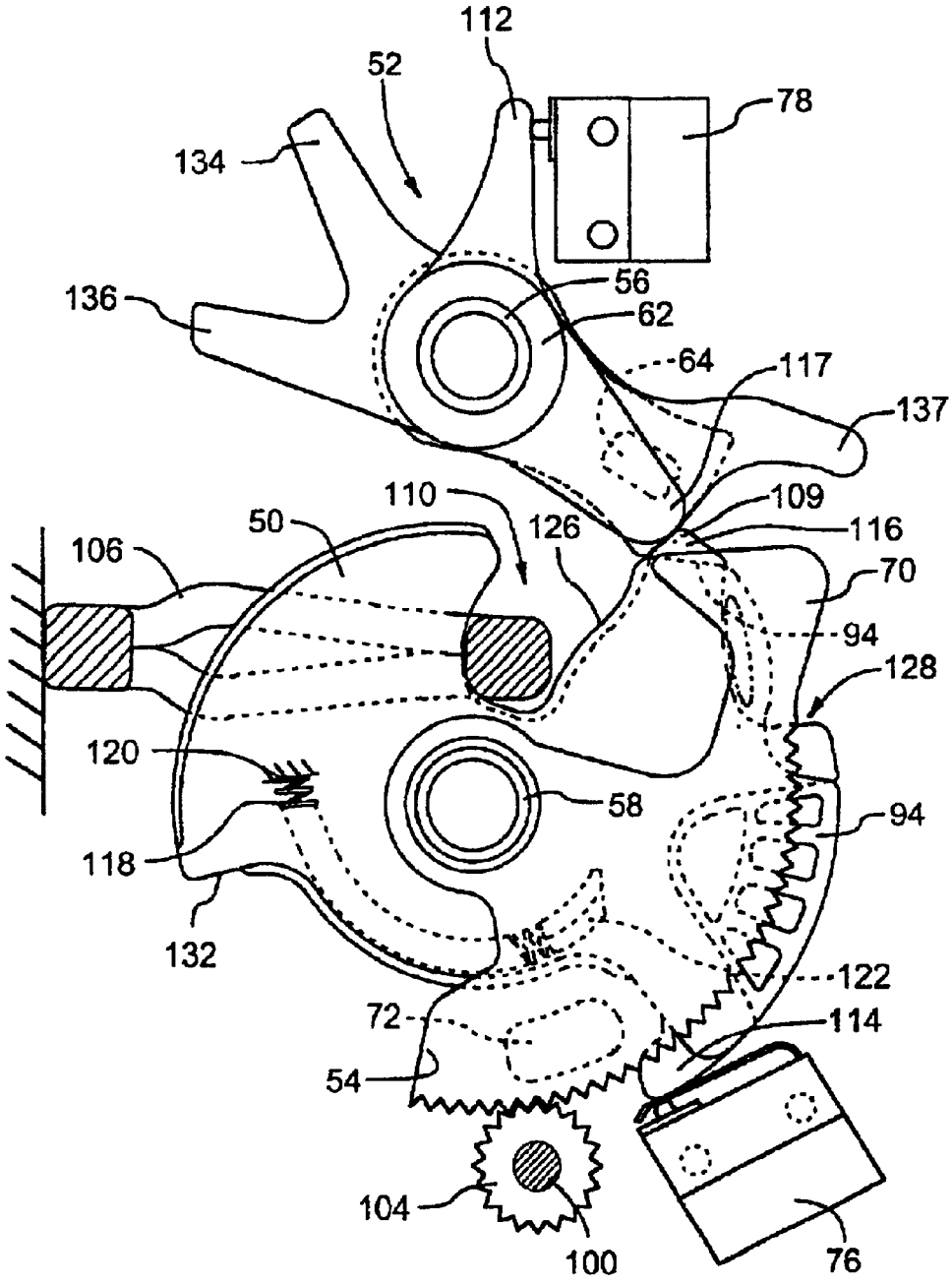
FIG. 8 is an elevational view showing a plurality of parts of the door latch assembly including a ratchet, a pawl, a sector gear, a first switch member and a second switch member in a primary latched configuration with a conventional striker shown in sectional view mounted on a door frame shown in fragmentary view.

FIG. 8 shows the neutral or equilibrium configuration of the door latch assembly 22 when the door is closed and latched. The ratchet 50 is in a primary latched position and the striker 106 is held in a notch 110 in the ratchet 50 to hold the door closed. The ratchet 50 is held in the primary latched position by the pawl 52.

Arm 112 on the release lever 62 holds the switch 78 in a depressed position. Release clearance area 114 of the ratchet 50 maintains the first switch 76 in a depressed position. The sector gear 54 is in the null position.

There is a small gap or design clearance 116 between the opening arm 70 on the sector gear 54 and arm 117 when the latch assembly 22 is in the primary latched position and the sector gear 54 is in the null position.

In this position, the clutch assembly 102 is de-energized to prevent any torque from the ratchet 50 or the sector gear 50 from being applied to the motor 98.

Unlatching and Opening the Door with Power Assistance

Figure 9:
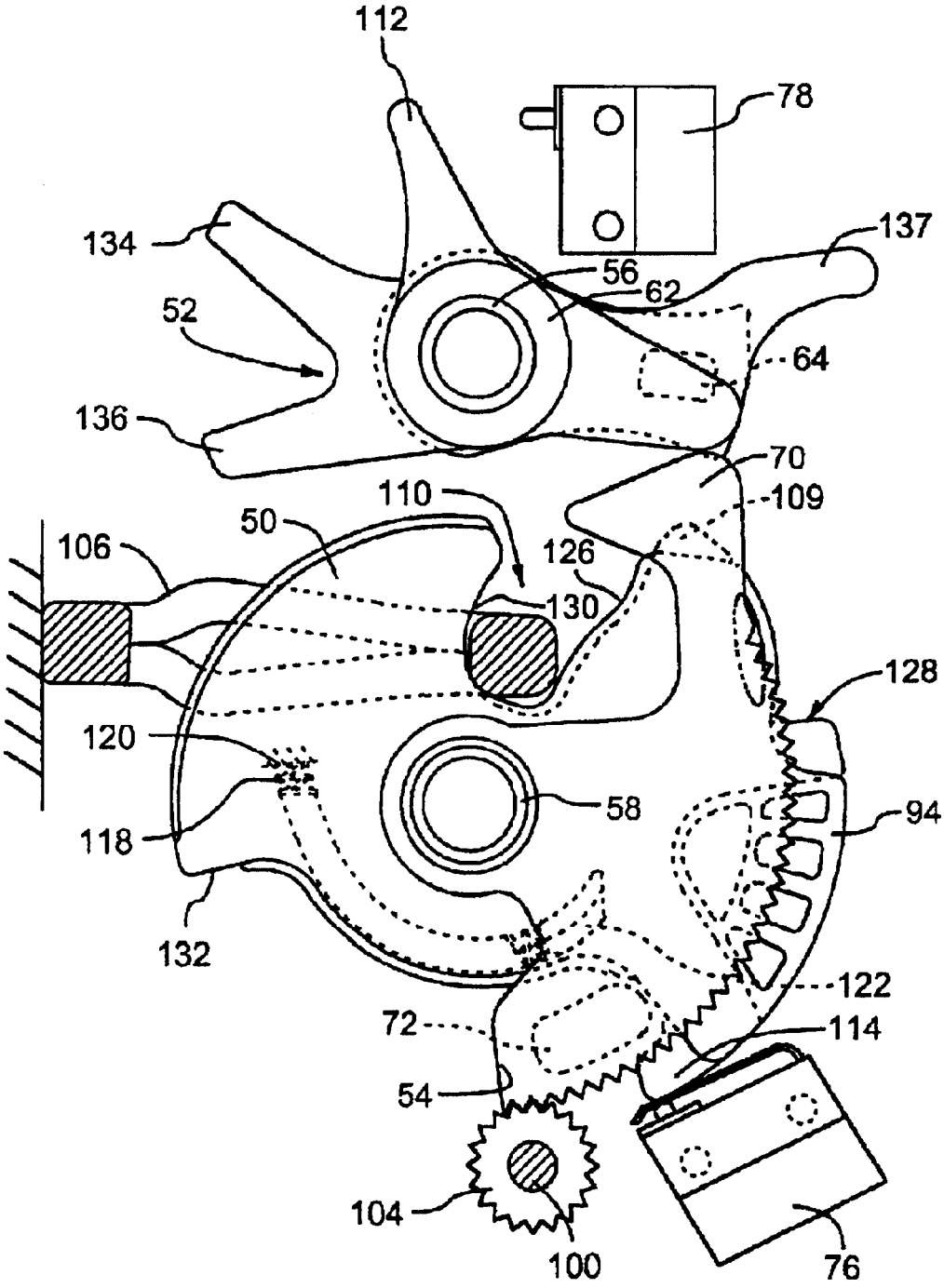
FIG. 9 is a view similar to FIG. 8 showing the pawl in a releasing position and the sector gear in an opening position.
Figure 10:
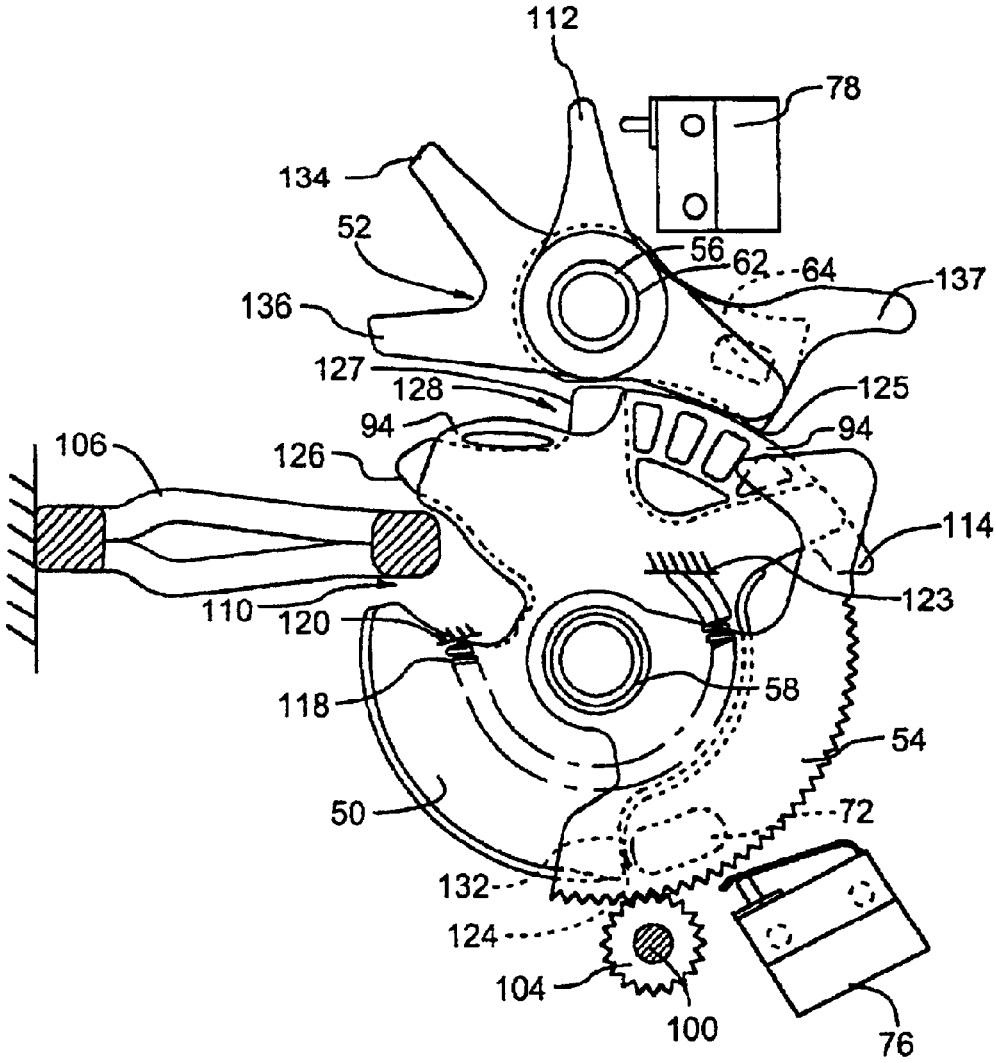
FIG. 10 is a view similar to FIG. 8 showing the door latch assembly in an unlatched position.
Figure 11:
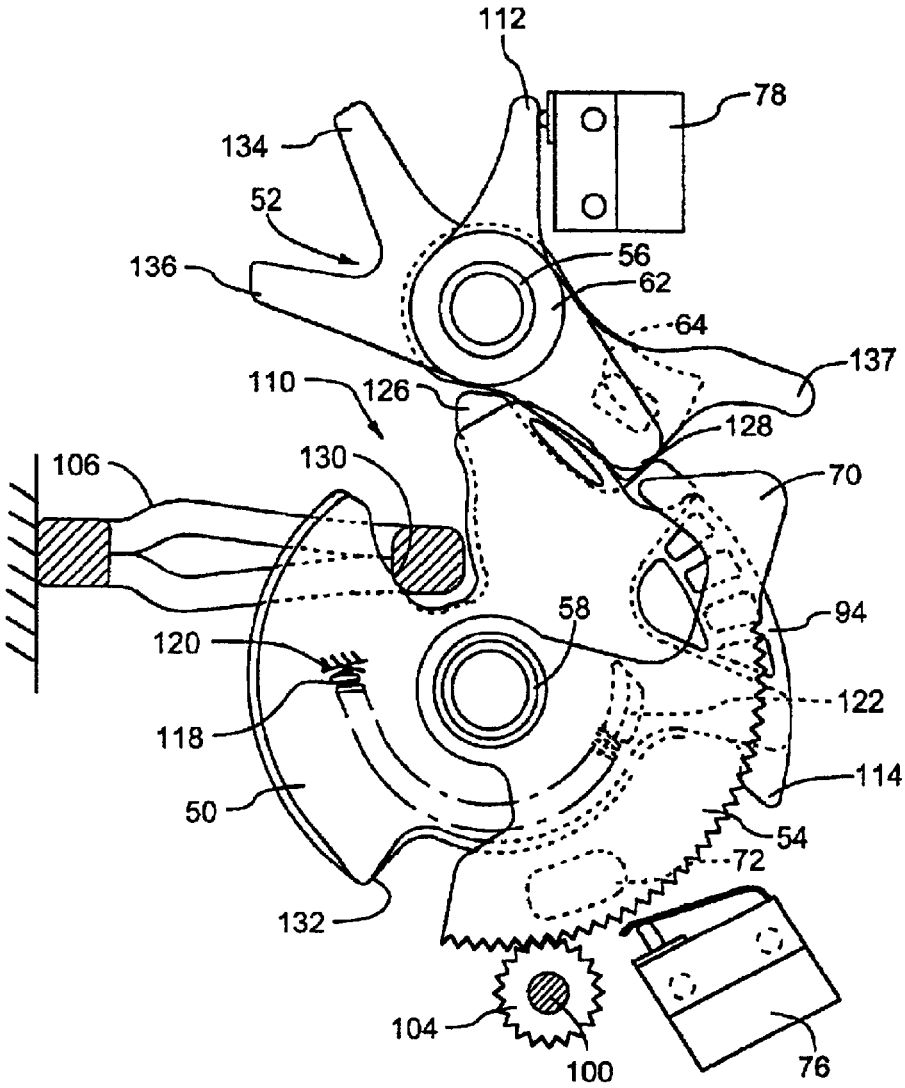
FIG. 11 is a view similar to FIG. 8 showing the door latch assembly in a secondary latched position.
Figure 12:
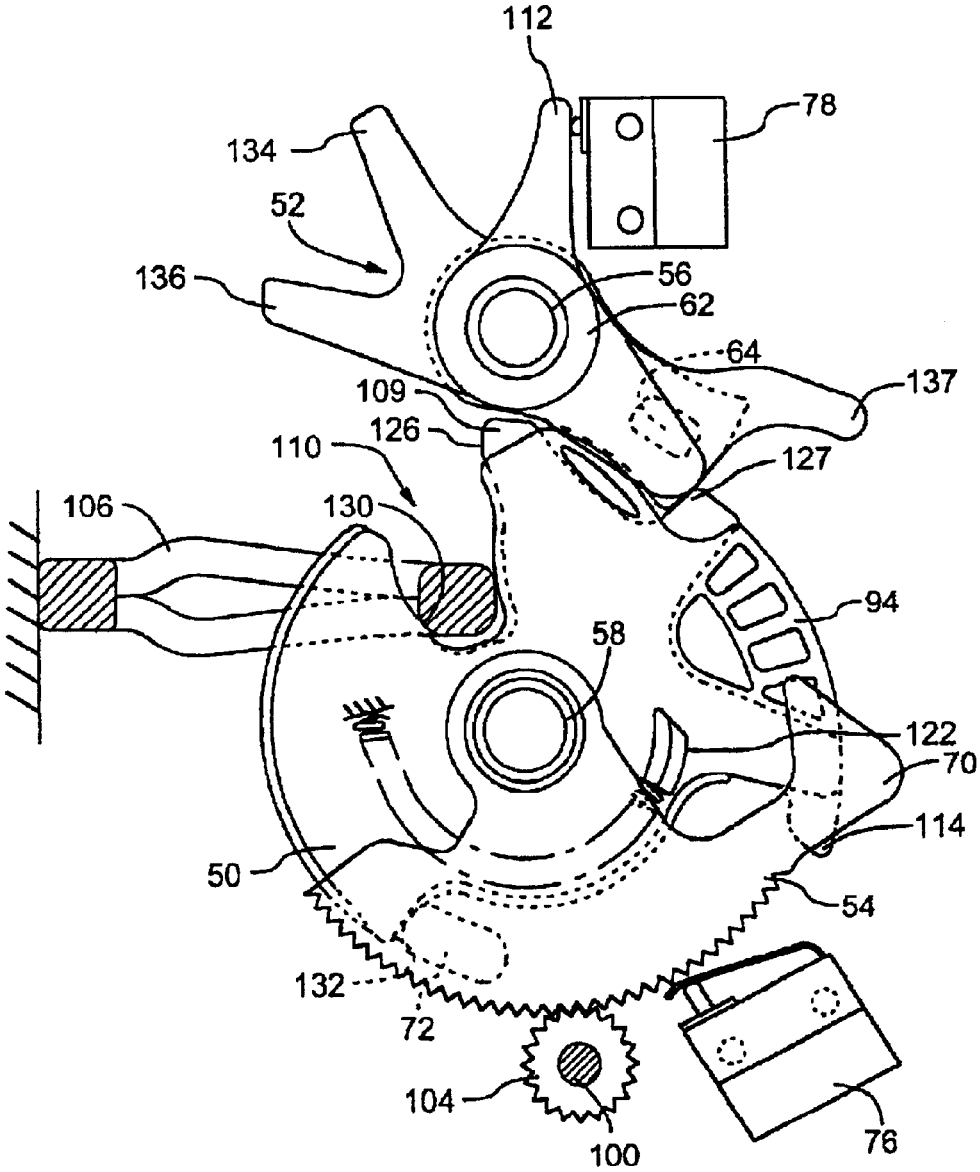
FIG. 12 is a view similar to FIG. 11 showing the door latch assembly in a secondary latched position and showing the sector gear partially rotated in a closing direction.
Figure 13:
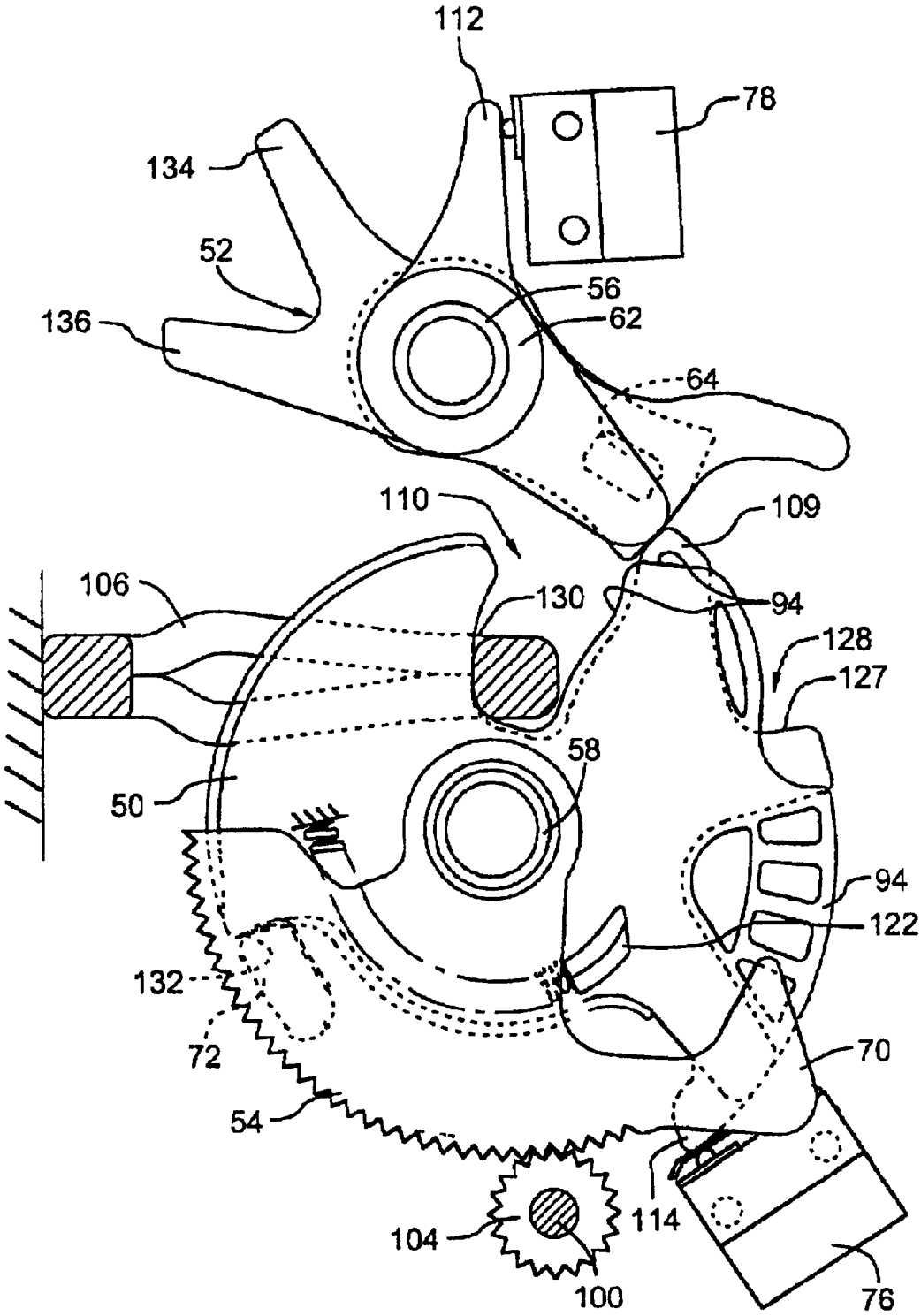
FIG. 13 is a view similar to FIG. 12 showing the ratchet in a primary latched position and showing the sector gear fully rotated in a closing direction.

To unlatch the door latch assembly 22 with power assistance, any one of the switches 18 or 32 on the door 12 or a switch 119 on the remote control 199 is actuated. Each switch 18, 32, 119 functions as an energizing switch and is independently operable to energize the motor 99. When the motor and clutch assembly 102 are energized, the motor 98 rotates the drive gear 104 in a first rotational direction to drive the sector gear 54 out of the null position in an opening direction through an opening stroke to an opening position. The opening direction of the sector fib gear 54 is the counterclockwise direction in FIGS. 8–9.

As the sector gear 54 pivots from the null position to its opening position, the releasing arm 70 contacts the arm 117 of release lever to pivot the pawl 52 from its latching position to its releasing position. Ratchet 50 pivots from the primary latched position to an unlatched position to release the striker 106 so the door can be opened.

Although the ratchet spring 118 provides enough force to pivot the ratchet 50 from the primary latched position to the unlatched position when the pawl 52 is moved to the releasing position, it can be understood that the seal pressure exerted by the door seal on the door also tends to move the door latch assembly 22 and the striker apart when the door is unlatched which tends to rotate the ratchet 50 to the unlatched position. However, it will also be appreciated that due to the torque amplification of the drive gear 104 acting upon the sector gear 54, the potential energy stored in the ratchet spring 118 will be greater than prior art devices. Consequently, the ratchet 50 will be able to pivot to the unlatched position with greater force than prior art devices and without increasing the size of the motor 98.

When the pawl 52 is in the releasing position, the arm 112 is moved away from the second switch 78 to toggle the second switch 78. When the ratchet 50 pivots from the primary latched position to the unlatched position, the cam surface of the release clearance area 114 of the ratchet 50 moves out of contact with the first switch 76 to toggle the first switch 76. In response to the toggling of the first switch 76, the control circuitry 108 de-energizes the motor 98. The actuator 96 holds the sector gear 54 in its opening position until the ratchet 50 has pivoted to the unlatched position. When the clutch assembly 102 is disengaged, the sector gear 54 pivots from the opening position through a return stroke back to its null position under the spring force provided by one of the sector springs 74. Consequently, any torque from the ratchet 50 or the sector gear 50 is precluded from being applied to the motor 98.

Closing and Relatching the Door with Power Assistance

Referring to FIGS. 10 to 13, the door latch assembly 22 engages striker 106 which enters the mouth 31 and engages the ratchet 50 which responsively pivots from the unlatched position toward the primary latched position. Because of the door seal pressure and the relatively lightweight of the vehicle door, the door may not have sufficient momentum to rotate the ratchet 50 all the way to the primary latched position.

Usually, the ratchet 50 is rotated to allow the pawl 52 to abut secondary stop 128. The ratchet 50 is retained in the secondary latched position. When the door latch assembly 22 is in the secondary latched position, the striker 110 is captured in the notch 110 and the door is partially closed and cannot be reopened without moving the pawl 52 to its releasing position.

When the pawl 52 engages the secondary stop 128, the arm 112 depresses the second switch 78. In response, the controller 108 energizes the motor 98 and clutch assembly 102. The motor 98 rotates the drive gear 104 in a second direction to cause the sector gear 54 to pivot in a closing direction through a closing stroke in a closing direction. The cinching arm 72 on the sector gear 54 contacts cinching stop 132 of the ratchet 50 so that continued movement of the sector gear 54 in the closing direction pivots or cinches the ratchet 50 from the secondary latched position to the primary latched position. The pawl 52 engages primary detent 126 to retain the ratchet 50 in the primary latched position.

When the ratchet 50 returns to the primary latched position, the releasing stop 114 of the ratchet 50 depresses and toggles the first switch 76. Both switches 76, 78 are now depressed. The first switch 76 functions as the closing de-energizing switch which signals the controller 1108, in responsive to the movement of the ratchet 50 moving into the primary latched position, to de-energize the motor 98 and disengage the clutch assembly 102. When the clutch assembly 102 is de-energized, springs 74 return the sector gear 54 from the closing position through a return stroke to the null position. The drive gear 104 and the drive shaft 100 freely rotate with the sector gear 54 as it returns to the null position. When the sector gear 54 is back in the null position, the door latch assembly 22 is again in the neutral or equilibrium position with any torque from the ratchet 50 or the sector gear 50 being precluded from being applied to the motor 98.

Unlatching and Opening the Door with Manual Override

The opening button 18 functions as an electrical switch when it is partially depressed through its actuation stroke and functions as a mechanical release means when it is fully depressed through its actuation stoke. Therefore, the opening button 18 is used to open the door with power assistance by partially depressing the button 18 through its actuation stroke and is used to open the door 12 manually with a mechanical override by fully depressing the button 18 through its full actuation stroke. The interior door release handle 34 on the inside of the door 12 is used to unlatch the door 12 manually with mechanical override.

The interior door release handle 34 is operatively connected through Bowden wire 80 to the pawl 52. By actuating the interior door release handle 34, the Bowden wire 80 is pulled to move the pawl 52 from its holding position to its releasing position to disengage the pawl 52 from the ratchet 50. The ratchet 50 then moves to its unlatched position under the spring force of the ratchet spring 118 and the seal load on the door 12.

The button 18 in the door 12 is mechanically linked in a conventional manner to the release wire 82. If the button 18 is fully depressed, it pulls the wire 82 in a direction to move the pawl from its holding position to its rotating position to release the ratchet 50.

It can be appreciated that the manual override provided by the button 18 and the interior handle 34 can release the ratchet 50 from either the primary latched position or secondary latched position to open the door 12. Each manual release 18, 34 functions independently and each holds the pawl 52 in the releasing position as long as the manual release 18 or 34 is held in an actuated position by the person opening the door 12.

It is contemplated to use many conventional manual release handles to unlatch the door latch assembly 22. It is also contemplated to use the door latch assembly 22 can also be used with any conventional manual or power operated door locking and unlocking system.

It can be understood that to close the open door and relatch the same in the primary latched position without power assistance, for example, in the event of a power failure, the door 12 is simply closed with greater force than is ordinarily used when power assistance is available. The manual closing force is applied to the door 12 must be sufficient to rotate the ratchet 50 to the primary latched position so the pawl 52 can move back into its holding position and engage the first tooth portion 109 of the ratchet 50. The door 12 must be closed hard enough to sufficiently compress the door seal on the door frame to allow relatching.

It is understood that the illustrated operation is exemplary only and not intended to be limiting.

The latch assembly 22 can be used in other applications. The door lath assembly can be used, for example, on a powered sliding door opening mechanism can start. It is contemplated to use the door latch assembly in a vehicle door which includes a power mechanism to move the door from the open position to the secondary latched position with power assistance.

The above-described embodiment of the invention is intended to be an example of the present invention and alterations and modifications may be effected thereto, by those of skill in the art, without departing from the scope of the invention, as defined in the appended claims.

We claim:

1. A power door latch assembly for engaging a door striker, comprising:

a ratchet for engaging the striker, the ratchet being rotatable between a closed position and an open position and including at least one detent surface and biasing member for biasing the ratchet towards the open position;

a pawl for engaging the at least one detent surface to selectively resist rotation of the ratchet towards the open position;

a rotary actuator for rotating the ratchet toward the closed position and for disengaging the pawl from the at least one detent surface;

a drive actuator including a prime mover, an output member in engagement with the rotary actuator, and a clutch coupled between the prime mover and the output member for selectively transferring torque between the prime mover and the rotary actuator;

a drive controller for controlling the operation of the drive actuator, the drive controller being coupled to the clutch and being configured for disengaging the prime mover from the rotary actuator when the ratchet is disposed in one of the closed and open positions;

said rotary actuator having a cinching arm engaging said ratchet upon rotation of said rotary actuator in a first sense to rotate said ratchet towards the closed position, and said rotary actuator having a relating arm engaging said pawl upon rotation of said rotary actuator in a second sense opposite said first sense to disengage said pawl from the at least one detent surface;

a release lever including an arm extending out therefrom, said release lever pivotally secured to said pawl such that said release lever rotates when said pawl rotates;

a first switch for selectively operating said clutch when said ratchet is disposed in the closed position, said first switch stopping said prime mover only when said first switch is closed; and a second switch for starting operation of said prime mover, said second switch actuated by said arm of said release lever only when said pawl engages said detent surface.

2. The power door latch assembly according to claim 1, wherein the rotary actuator is rotatable through a null position wherein the rotary actuator is disengaged from the ratchet and the pawl.

3. The power door latch assembly according to claim 2, wherein the drive controller is configured for disengaging the prime mover from the rotary actuator when the rotary actuator is disposed in the null position.

4. The power door latch assembly according to claim 3, wherein the rotary actuator includes a lost motion linkage for allowing limited rotational movement of the ratchet relative to the rotary actuator when the ratchet is disposed in the open position.

5. The power door latch assembly according to claim 4, wherein one of the at least one detent surfaces is disposed for providing in cooperation with the pawl a partially open position between the open and closed positions, and the limited rotational movement is provided between the open and partially open positions.

6. The power door latch assembly according to claim 5, wherein said ratchet includes a cam surface disposed for engagement with the first switch when the ratchet is disposed in the closed position.

7. The power door latch assembly according to claim 6, including a manual release coupled to the pawl for releasing the pawl from the ratchet upon activation of the manual release.

8. The power door latch assembly according to claim 7, wherein the ratchet is disposed for rotation about a first axis, and the pawl is disposed for rotation for about a fixed axis parallel to the first axis.

9. The power door latch assembly according to claim 8, wherein the drive actuator is disposed for rotation about the first axis.

* * * * *

UNITED STATES PATENT AND TRADEMARK OFFICE

CERTIFICATE OF CORRECTION

PATENT NO. : 6,848,727 B1
DATED : February 1, 2005
INVENTOR(S) : Cetnar et al.

It is certified that error appears in the above-identified patent and that said Letters Patent is hereby corrected as shown below:

Column 1,
Line 8, between "for" and "and" please insert -- latching --.
Line 9, please delete "pillar in particular," and insert -- pillar. In particular --.
Line 10, please delete "powder" and insert -- power --.
Line 63, please delete "Kobayahi" and insert -- Kobayashi --.

Column 4,
Line 9, please delete "am" and insert -- are --.

Column 9,
Line 34, please delete "lath" and insert -- latch --.
Line 35, after "door" and before "opening" please insert -- of a type frequently found in van-type vehicles where the latch has to be released before the power door --.

Signed and Sealed this

Tenth Day of May, 2005

JON W. DUDAS
*Director of the United States Patent and Trademark Office*